US012310501B1

(12) United States Patent
Katsaunis

(10) Patent No.: US 12,310,501 B1
(45) Date of Patent: May 27, 2025

(54) INFLATABLE LOUNGE CHAIR

(71) Applicant: BeachBack LLC, Denver, CO (US)

(72) Inventor: Alexandros Katsaunis, Denver, CO (US)

(73) Assignee: BeachBack LLC, Denver, CO (US)

( * ) Notice: Subject to any disclaimer, the term of this patent is extended or adjusted under 35 U.S.C. 154(b) by 181 days.

(21) Appl. No.: 18/209,113

(22) Filed: Jun. 13, 2023

(51) Int. Cl.
*A47C 1/024* (2006.01)
*A47C 1/14* (2006.01)
*A47C 4/54* (2006.01)

(52) U.S. Cl.
CPC ..... *A47C 1/0244* (2013.01); *A47C 1/146* (2013.01); *A47C 4/54* (2013.01)

(58) Field of Classification Search
CPC ..... A47C 1/146; A47C 4/54; A47C 1/0244
USPC ..... 297/452.41
See application file for complete search history.

(56) References Cited

U.S. PATENT DOCUMENTS 7,231,681 B2 * 6/2007 Kasatshko ..... A47C 27/10 5/733
7,992,241 B2 * 8/2011 Davis, III ..... A47C 20/048 5/710
8,783,781 B1 * 7/2014 McClure ..... A47C 4/54 297/452.41

FOREIGN PATENT DOCUMENTS

FR 3008291 A1 * 1/2015 ..... A47C 17/045

* cited by examiner

*Primary Examiner* — Milton Nelson, Jr.
(74) *Attorney, Agent, or Firm* — Bamert Regan PLLC

(57) ABSTRACT

Embodiments are directed toward a lounge chair. In some embodiments, the lounge chair includes an inflatable backrest and a mat coupled to the inflatable backrest. The inflatable backrest includes an upper chamber with a first air valve, and a lower chamber with a second air valve. The upper chamber and lower chamber are selectively inflatable. Accordingly, the lounge chair is adjustable while being lightweight and portable.

18 Claims, 7 Drawing Sheets

INFLATABLE LOUNGE CHAIR

FIELD OF THE INVENTION

The invention relates generally to lounge chairs and, more particularly, to lounge chairs with inflatable backrests.

BACKGROUND OF THE INVENTION

In some cases, a user may wish to rest on a beach, lawn, or other location. While a towel, mat, or blanket may provide protection from the ground, a user may be uncomfortable without a backrest. Lounge chairs may provide comfort and back support to a user wishing to recline. However, known lounge chairs have several drawbacks.

Many styles of lounge chairs fail to provide adjustability. For example, many lounge chairs have a fixed backrest. In this case, the lounge chair provides a single position in which a user can lie on the lounge chair. Some users may not find the fixed position of the backrest comfortable. In some known approaches, lounge chairs include an inflatable backrest. In these approaches, a single air chamber is inflated to provide a backrest. However, because these inflatable backrests require full inflation to support the user's back, these inflatable backrests lack adjustability.

Known lounge chairs that provide backrest adjustability are heavy and lack portability. For example, lounge chairs are often made from heavy and rigid materials that make it difficult to transport the lounge chairs to different locations. These adjustable lounge chairs are made from rigid materials such as wood, metal, and foam. While the position of the backrest may be adjusted at a hinge, these lounge chairs are bulky and heavy. A user may not be able to move the lounge chair from one location to another.

For these reasons, there is a need for lounge chairs that have adjustable backrests. There is also a need for lounge chairs with adjustable backrests that are lightweight and portable.

SUMMARY OF THE INVENTION

It is therefore an object of the present invention to provide a lounge chair that is lightweight and portable.

It is also an object of the present invention to provide a lounge chair that achieves the above object and that also includes an adjustable backrest.

The invention achieves the above objects, as well as other objects and advantages that will become apparent from the description that follows, by providing an inflatable backrest. In some embodiments, the inflatable backrest includes an upper chamber with a first air valve and a lower chamber with a second air valve, the upper chamber and lower chamber being selectively inflatable. Air in the upper chamber is kept separate from air in the lower chamber. In some embodiments, a mat is coupled to the inflatable backrest.

In some embodiments, when the upper chamber is inflated, the upper chamber retains an inflated shape upon deflation of the lower chamber. In some embodiments, the upper chamber forms a wedge shape upon inflation of the upper chamber. In some embodiments, the lower chamber forms a wedge shape upon inflation of the lower chamber.

In some embodiments, inflation of the upper and lower chambers provides approximately sixty degrees of adjustment to the inflatable backrest. Inflation of the lower chamber provides approximately thirty degrees of adjustment to the inflatable backrest, and inflation of the upper chamber provides approximately another thirty degrees of adjustment to the inflatable backrest.

In some embodiments, an upper surface of the upper chamber is configured to contact a back of a user. In some embodiments, the upper surface includes a microfiber coating. In some embodiments, a bottom surface of the lower chamber is configured to contact a ground surface.

In some embodiments, a first connecting material attaches the upper chamber to the lower chamber. In some embodiments, a second connecting material attaches the upper chamber to the mat. In some embodiments, a third connecting material attaches the lower chamber to the mat.

In some embodiments, the inflatable backrest is foldable upon deflation of the upper chamber and lower chamber.

The invention also achieves the above objects, as well as other objects and advantages that will become apparent from the description that follows, by providing a method of using a lounge chair with an inflatable backrest. The method includes providing the lounge chair with an inflatable backrest, inflating an upper chamber by inserting air into a first air valve, and inflating a lower chamber by inserting air into a second air valve. Accordingly, the method facilitates adjusting an angle of the backrest by separately inflating or deflating the upper chamber and lower chamber.

In some embodiments, the method also includes deflating the lower chamber by removing air through the second air valve. The upper chamber retains an inflated shape independent of deflation of the lower chamber. In some embodiments, the method includes deflating the upper chamber by removing air through the first air valve. In some embodiments, the method includes folding the lounge chair upon deflation of the upper chamber and the lower chamber.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

Figure 1:
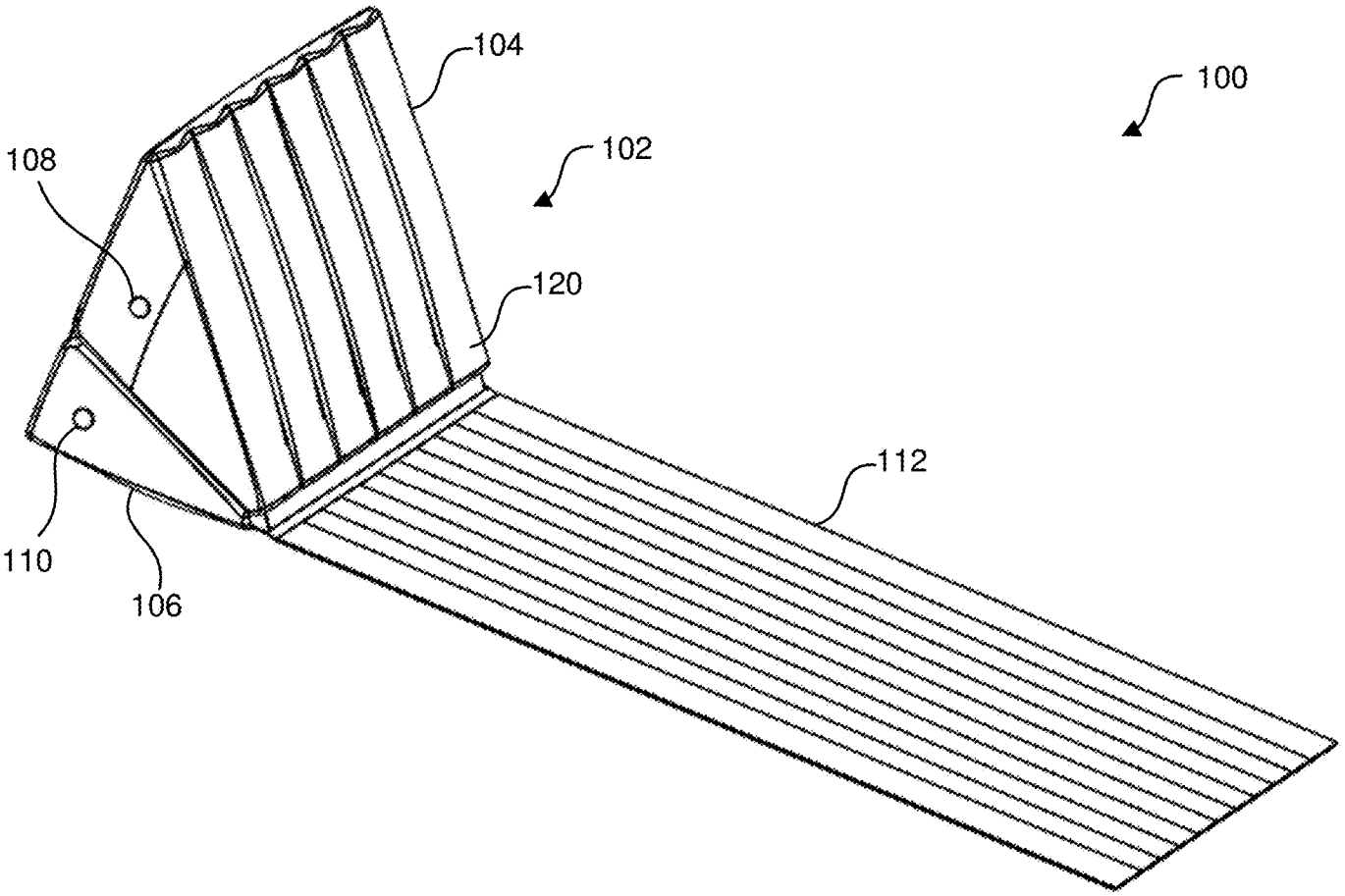
FIG. 1 is an isometric front perspective view of a lounge chair according to the principles of the present invention.
Figure 2:
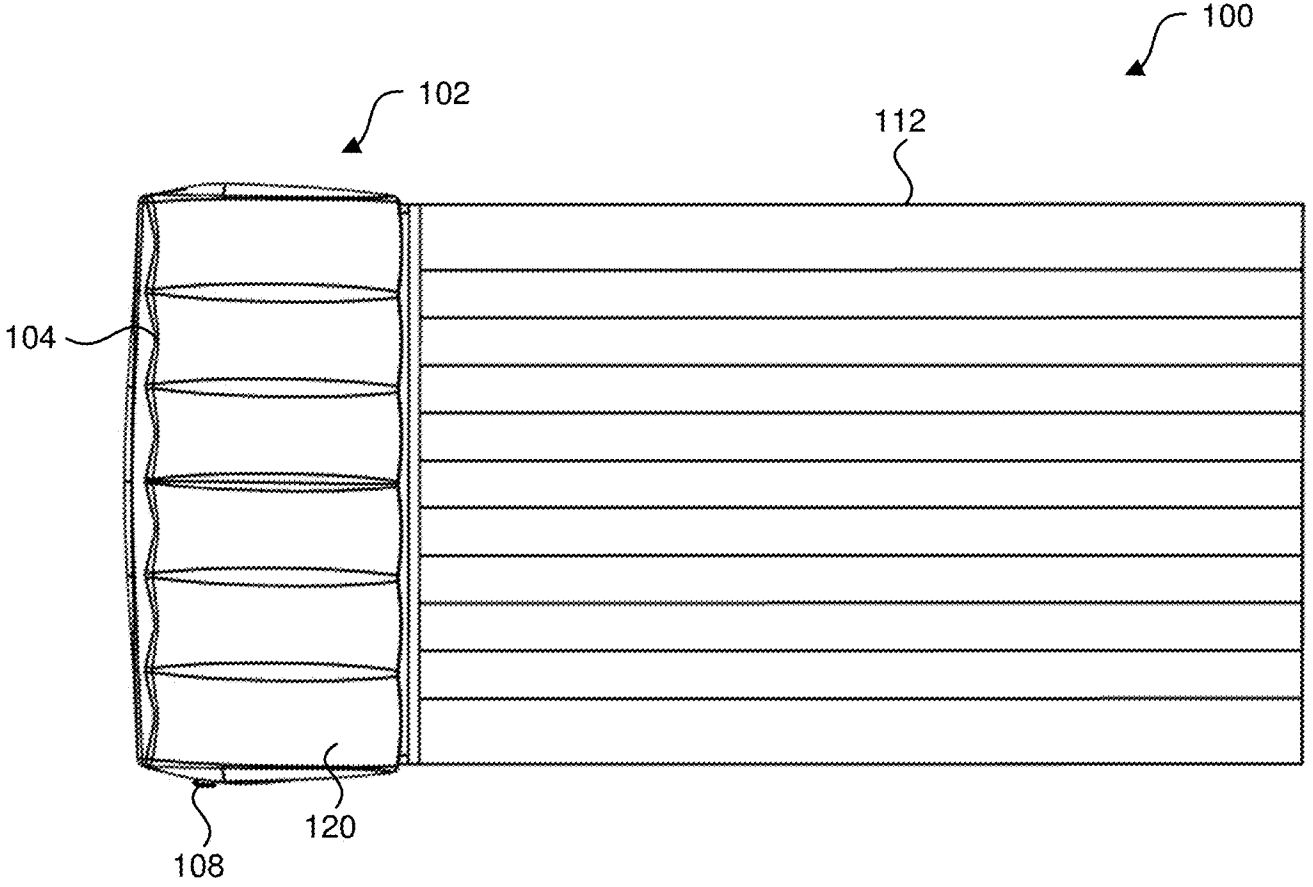
FIG. 2 is a top plan view of the lounge chair of FIG. 1.
Figure 3:
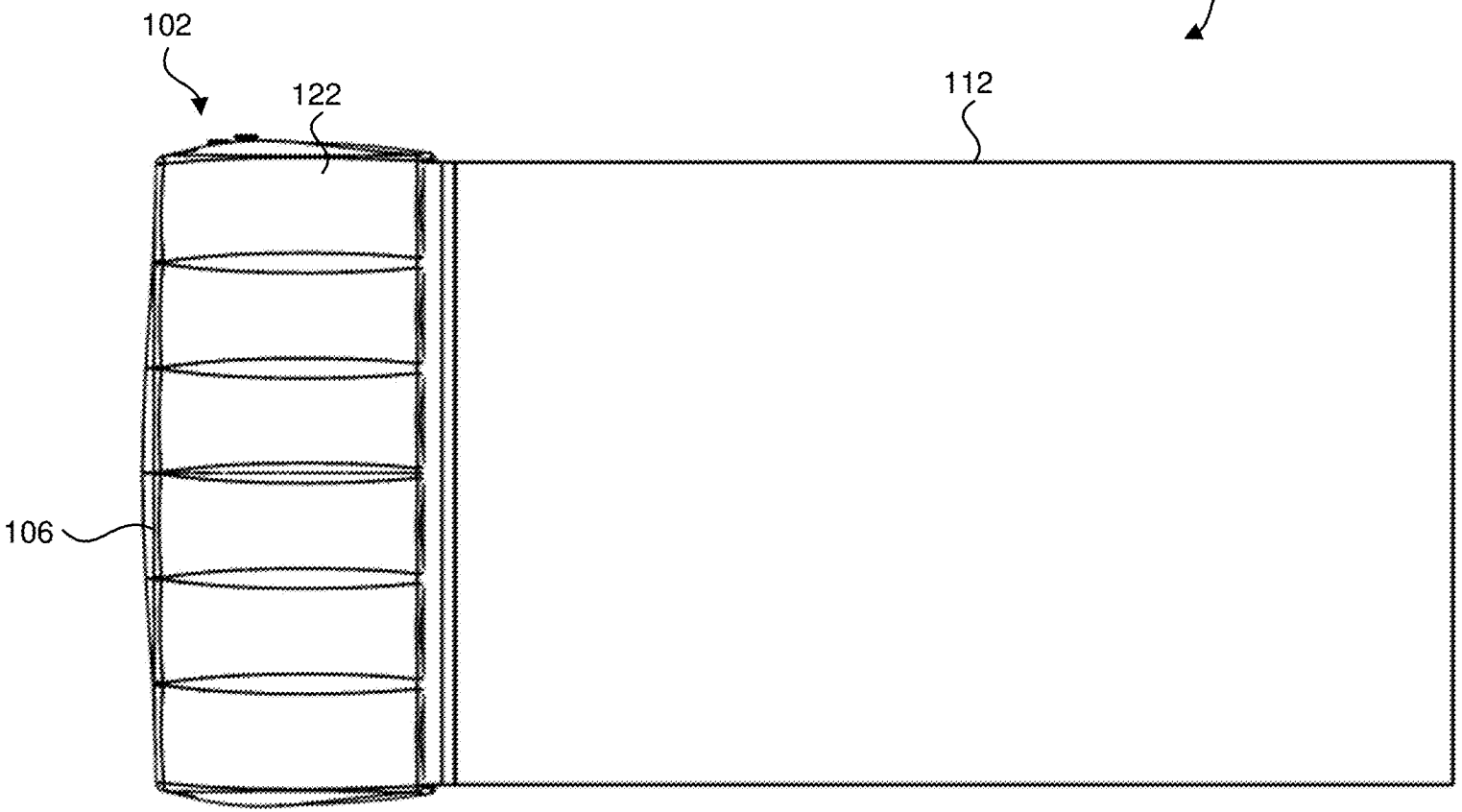
FIG. 3 is a bottom plan view of the lounge chair of FIG. 1.
Figure 4:
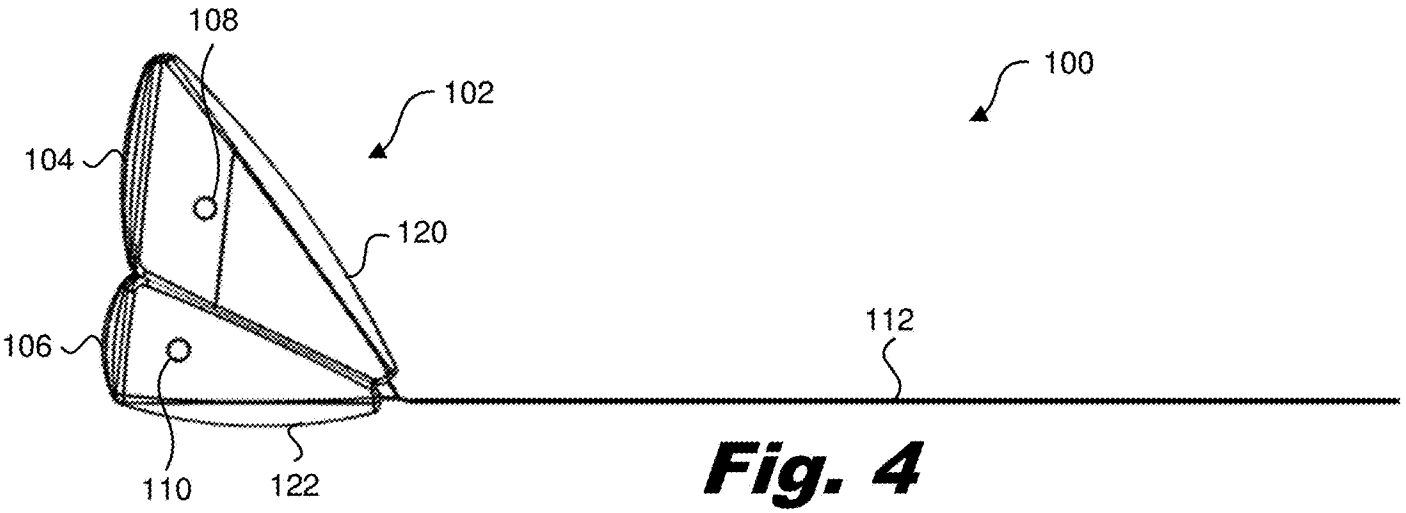
FIG. 4 is a left elevational view of the lounge chair of FIG. 1.
Figure 5:
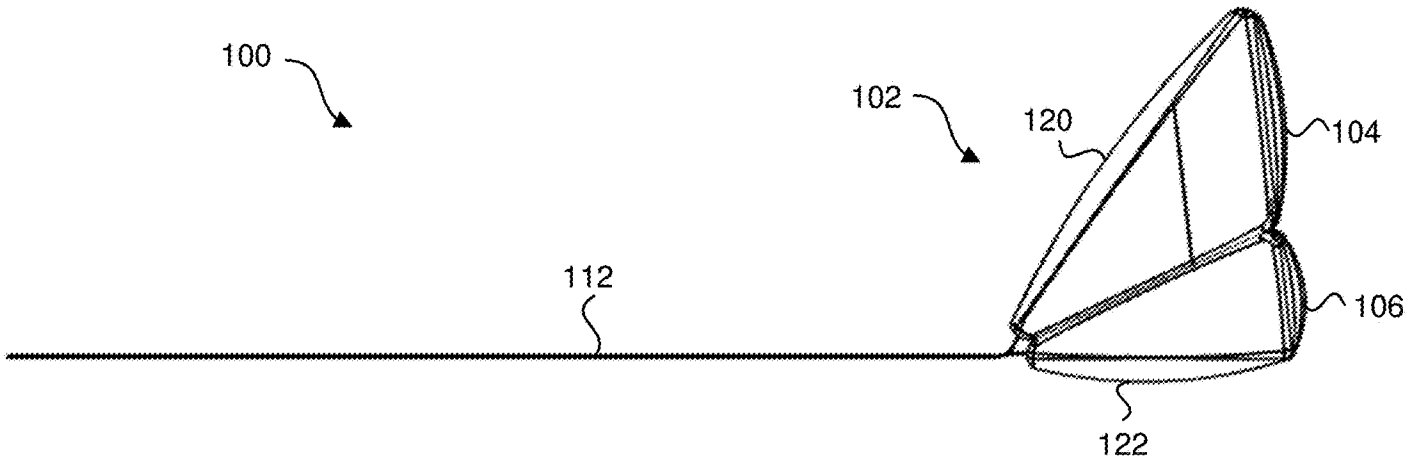
FIG. 5 is a right elevational view of the lounge chair of FIG. 1.
Figure 7:
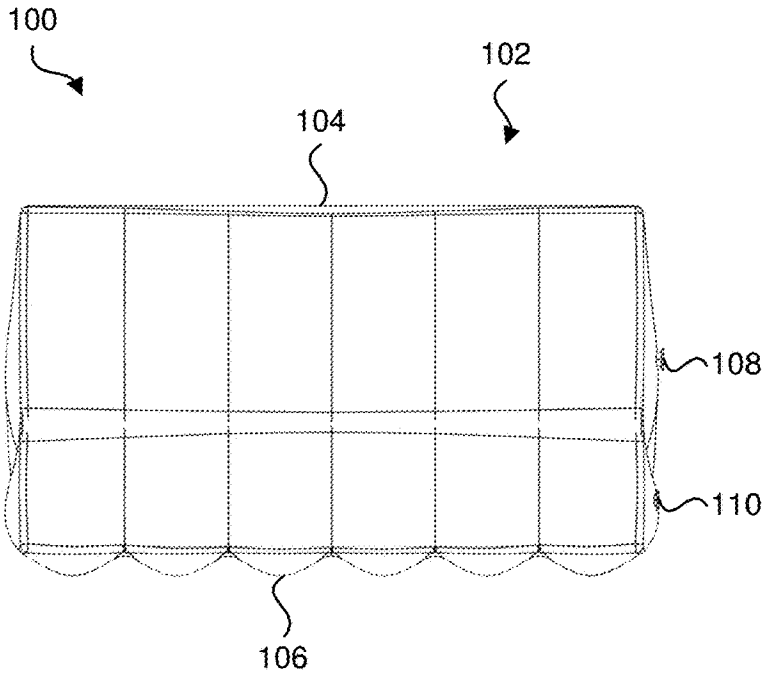
FIG. 7 is a rear elevational view of the lounge chair of FIG. 1.
Figure 6:
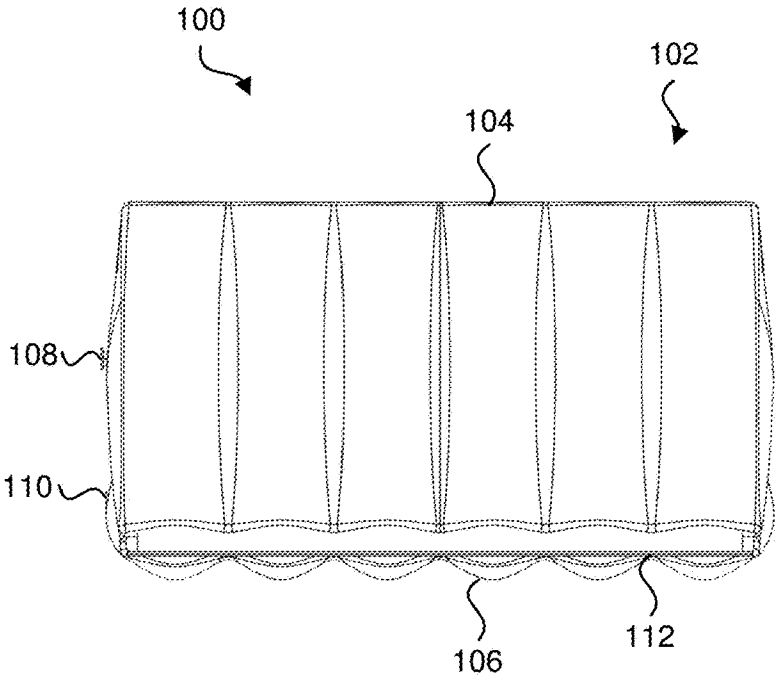
FIG. 6 is a front elevational view of the lounge chair of FIG. 1.

Inflatable lounge chairs in accordance with the principles of the invention are generally indicated at reference number 100 in the Figures of the attached drawings, wherein numbered elements in the Figures correspond to like numbered elements herein.

As shown in FIGS. 1-7, the lounge chair 100 includes an inflatable backrest 104 coupled to a mat 112. In some embodiments, the inflatable backrest 104 and the mat 112 are formed from the same material. For example, a flexible polymer (e.g., polyvinyl chloride, flocked vinyl, chlorosulfonated polyethylene, polyurethane, thermoplastic polyurethane, nylon, rubber) may be used to form both the inflatable backrest 104 and the mat 112. In some embodiments, the inflatable backrest 104 and the mat 112 are formed from different materials. For instance, the inflatable backrest 104 may be formed from a first polymer and the mat may be formed from second polymer, a textile material, straw, or other material.

In some embodiments, the inflatable backrest 102 includes an upper chamber 104 and a lower chamber 106. The upper chamber 104 includes a first air valve 108 to receive air into the upper chamber 104. The lower chamber 106 includes a second air valve 110 to receive air into the lower chamber 106. The upper chamber 104 and the lower chamber 106 are selectively inflatable such that one or both chambers 104, 106 can be inflated or deflated at a time. Once inflated, the upper chamber 104 and the lower chamber 106 retain air until the air is released through a corresponding air valve 108, 110.

The upper chamber 104 and the lower chamber 106 are formed such that air in the upper chamber 104 is kept separate from air in the lower chamber 106. In some embodiments, the upper chamber 104 and the lower chamber 106 are flexible bags that can be inflated with air or other gas. In some embodiments, the upper chamber 104 and the lower chamber 106 are formed with separate membranes such that no walls are shared between the upper chamber 104 and the lower chamber 106. In some embodiments, the upper chamber 104 and the lower chamber 106 share at least one wall, but in a manner that air is restricted from passing between the chambers 104, 106.

In some embodiments, the chambers 104, 106 can be inflated and deflated independent of each other. For instance, the upper chamber 104 is inflated and deflated independent of the lower chamber 106. Similarly, the lower chamber 106 is inflated and deflated independent of the upper chamber 104. It should be noted that because the upper chamber 104 can be inflated while the lower chamber 106 is deflated, the upper chamber 104 retains its inflated shape when the lower chamber 106 is deflated. In other words, when the upper chamber 104 is inflated, the upper chamber 104 retains an inflated shape upon deflation of the lower chamber.

In some embodiments, the upper chamber 104 and the lower chamber 106 form wedge shapes upon inflation. In FIGS. 1-7, the upper chamber 104 and the lower chamber 106 are shown inflated. When inflated, the upper chamber 104 and the lower chamber 106 have wedge shapes that taper out from the mat 112 at an angle. It should be noted that when deflated, the upper chamber 104 and the lower chamber 106 may be substantially flat.

In some embodiments, the inflatable backrest 102 is foldable upon deflation of the upper chamber 104 and the lower chamber 106. Because the upper chamber 104 and the lower chamber 106 are formed from flexible materials, the inflatable backrest 102 can be folded or rolled into a compact shape. Similarly, in some embodiments, the mat 112 is formed from flexible materials such that the entire lounge chair 100 can be folded to a compact shape upon deflation of the upper chamber 104 and the lower chamber 106.

In some embodiments, the upper chamber 104 includes an upper surface 120 that is configured to contact the back of a user. As such, a user can recline on the upper surface 120 of the upper chamber 104. In some embodiments, the upper surface 120 includes a number of grooves to add structural stability and to reduce bulging of the upper chamber 104 upon inflation. In some embodiments, the upper surface 120 is smooth or has other surface textures. In some embodiments, the upper surface 120 is formed with a microfiber coating.

In some embodiments, the lower chamber 106 has a bottom surface 122 configured to contact a ground surface (e.g., sand, lawn, flooring, etc.). As with the top surface 120, in some embodiments, the bottom surface 122 includes a number of grooves. In other embodiments, the bottom surface 122 is smooth or has other surface textures.

In some embodiments, the mat 112 includes a textured upper surface. For instance, the surface on which a user contacts the mat 112 may be formed with a microfiber coating. It should be noted that, in some embodiments, the mat 112 is non-inflatable. In some embodiments, the mat 112 is inflatable separate from the upper and lower chambers 104, 106.

Figure 8:
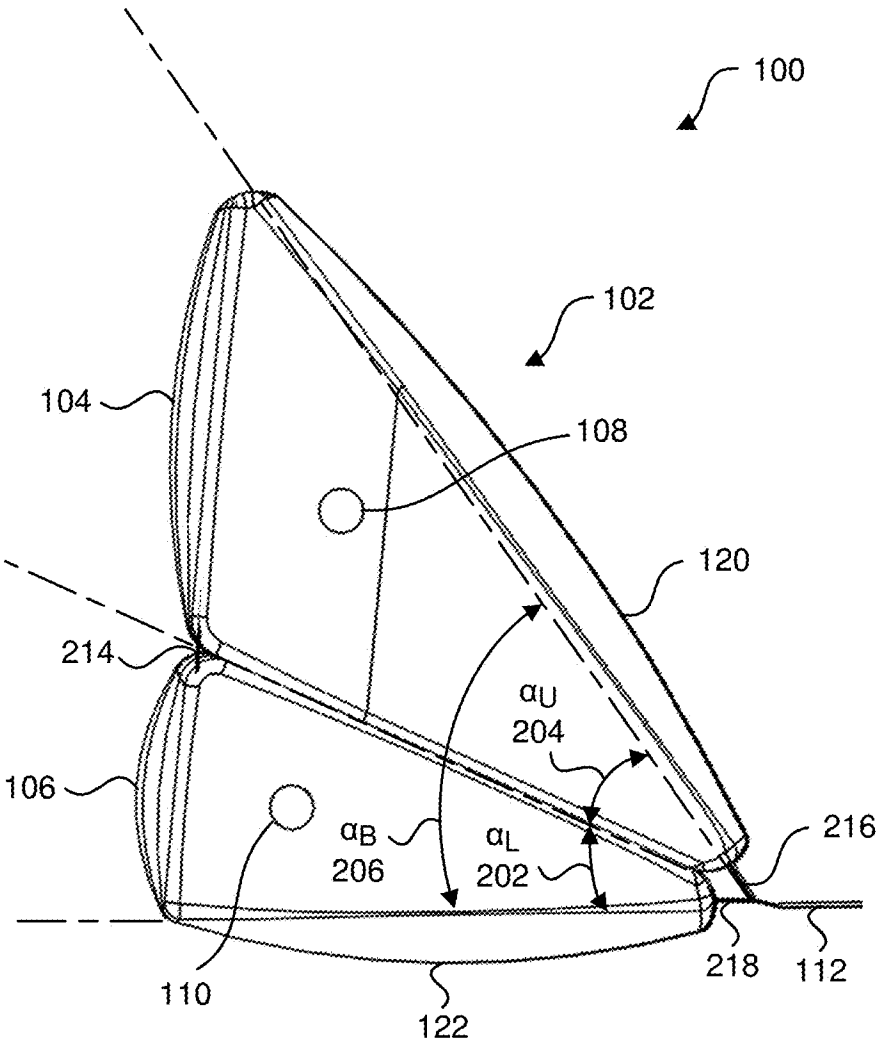
FIG. 8 is a left elevational detail view of the lounge chair of FIG. 1.

Referring now to FIG. 8, the combination of the upper and lower chambers 104, 106 provide for adjustment of the inflatable backrest 102. In some embodiments, inflation of the upper and lower chambers 104, 106 provides approximately sixty degrees of adjustment to the inflatable backrest 102, as denoted by angle αB 206. In some embodiments, inflation of the lower chamber 106 provides approximately thirty degrees of adjustment to the inflatable backrest 102, as denoted by angle αL 202. In an example, inflation of the lower chamber 106 causes the inflated upper chamber 104 to rise and pivot through a range of approximately thirty degrees. Inflation of the upper chamber 104 provides approximately thirty degrees of adjustment to the inflatable backrest 102, as denoted by angle αU 204. The summation of the lower chamber angle αL 202 and the upper chamber angle αU 204 provides approximately sixty degrees of adjustability for the angle αB 206 of the inflatable backrest 102. It should be noted that other angle values for αL 202 and QU 204 may be implemented in other embodiments.

In some embodiments, the upper chamber 104 attaches to the lower chamber 106 with a first connecting material 214. In some embodiments, the first connecting material 214 is a flexible sheet, film, or membrane that is connected to both the upper chamber 104 and the lower chamber 106. The first connecting material 214 keeps the upper chamber 104 aligned with the lower chamber 106 while allowing the chambers 104, 106 to change shape during inflation and deflation.

In some embodiments, a second connecting material 216 attaches the upper chamber 104 to the mat 112 and a third connecting material 218 attaches the lower chamber 106 to the mat 112. As with the first connecting material 214, in some embodiments, the second and third connecting materials 216, 218 are flexible sheets, films, or membranes. In some embodiments, the upper chamber 104 and the lower chamber 106 connect directly to the mat 112 without an intervening material.

Figure 9:
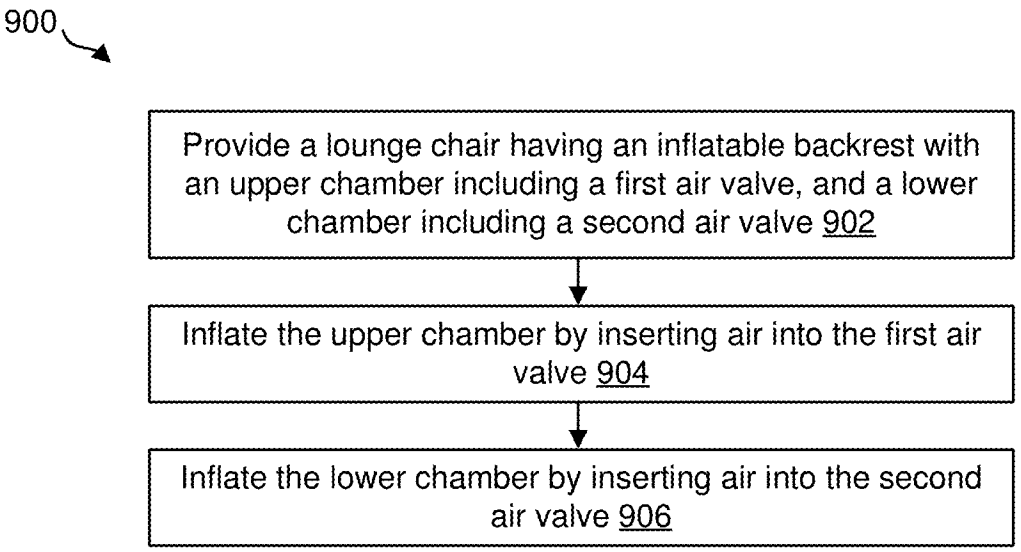
FIG. 9 is a flow diagram illustrating a method of using the lounge chair of FIG. 1.

FIG. 9 is a flow diagram illustrating a method 900 for using a lounge chair 100 with an inflatable backrest 102, according to an example of the embodiments described herein. At block 902, a lounge chair 100 is provided with an inflatable backrest 102 having an upper chamber 104 including a first air valve 108 and a lower chamber 106 including a second air valve 110. The lounge chair 100 also includes a mat 112 coupled to the inflatable backrest 102. At block 904, the upper chamber 104 is inflated by inserting air into the first air valve 108. For example, a user may introduce air into the upper chamber 104 by blowing into the first air valve 108. At block 906, the lower chamber 106 is inflated by inserting air into the second air valve 110. For example, the user may introduce air into the lower chamber 106 by blowing into the second air valve 110. The air in the upper chamber 104 is kept separate from the air in the lower chamber 106.

In some embodiments, the method 900 includes deflating the lower chamber 106 by removing air through the second air valve 110. For example, the user may open the second air valve 110 to allow air to escape from the lower chamber 106. In this manner, the user causes the upper chamber 104 to reach a desired position. Thus, the angle of the inflated upper chamber 104 is adjusted relative to the mat 112 by inflating or deflating the lower chamber 106. Because the first air valve 108 remains closed, the upper chamber 104 retains an inflated shape independent of deflation of the lower chamber 106.

In some embodiments, the method 900 includes deflating the upper chamber 104 by removing air through the first air valve 108. The deflation of the upper chamber 104 occurs independent of the lower chamber inflation. Thus, the lower chamber 106 may or may not be inflated when the upper chamber 104 is deflated.

In some embodiments, the method 900 includes folding the lounge chair 100 upon deflation of the upper chamber 104 and the lower chamber 106. For example, once a sufficient amount of air is removed from both chambers 104, 106, the user may fold or roll the lounge chair 100 into a compact shape. Thus, the lounge chair 100 is easily portable and storable. Furthermore, by using an inflatable backrest 102, the lounge chair 100 is lightweight and easily moved in either an inflated or deflated state.

The terms "front," "forward," "rear," and "rearward" are defined relative to the lounge chair, such as the lounge chair 100, when the lounge chair is unfurled and positioned on a ground surface. The terms "front" and "forward" indicate the direction oriented from the inflatable backrest toward the mat of the lounge chair. The terms "rear" and "rearward" indicate the opposite of the front or forward direction. The terms "height," "vertical," "upper," "lower," "above," "below," "top," "bottom," "topmost," and "bottom-most" are defined relative to a vertical axis of the lounge chair. The vertical axis is non-parallel to the longitudinal axis and is defined as parallel to the direction of the earth's gravity force on the lounge chair when the lounge chair is on horizontal ground. The term "lateral" is defined relative to the lateral axis of the lounge chair. The lateral axis is non-parallel to the longitudinal and vertical axes. The longitudinal axis is of the lounge chair is substantially central in the lounge chair and substantially parallel to the forward and rearward directions.

The term "configured" as used herein means an element being one or more of sized, dimensioned, positioned, or oriented to achieve or provide the recited function or result. The term "directly coupled" as used herein means that a component contacts (for example, when bolted) or is welded to another component. The term "indirectly coupled" as used herein means that a first component is coupled to a second component by way of one or more intervening components that are directly coupled to the first and second components. For example, a first component that is indirectly coupled to a second component is directly coupled to a third component, which may be directly coupled to the second component or to a fourth component that is directly coupled to the second component. The term "coupled" should therefore be understood to disclose both direct and indirect coupling of components or elements that are described as being coupled to each other.

The term "approximately" or "substantially" refers to within 1, 5, 10, 15, 20, 25, 30, 40, or 50 percent of the identified value or range.

As used herein, the following terms take the meanings explicitly associated herein, unless the context clearly dictates otherwise. The term "or" is an inclusive grammatical conjunction to indicate that one or more of the connected terms may be employed. For example, the phrase "one or more A, B, or C" or the phrase "one or more As, Bs, or Cs" is employed to discretely disclose each of the following: i) one or more As, ii) one or more Bs, iii) one or more Cs, iv) one or more As and one or more Bs, v) one or more As and one or more Cs, vi) one or more Bs and one or more Cs, and vii) one or more As, one or more Bs, and one or more Cs. The term "based on" as used herein is not exclusive and allows for being based on additional factors not described. The articles "a," "an," and "the" include plural references. Plural references are intended to also disclose the singular.

While the preferred embodiment of the invention has been illustrated and described, as noted above, many changes can be made without departing from the spirit and scope of the invention. For example, each disclosure of a component preferably having a feature or characteristic is intended to also disclose the component as being devoid of that feature or characteristic, unless the principles of the invention clearly dictate otherwise. Accordingly, the scope of the invention is not limited by the disclosure of the preferred embodiment. Instead, the invention should be determined entirely by reference to the claims that follow. It should also be noted that the claim dependencies or combinations of elements recited in the claims does not reflect an intention to forgo claiming other subject matter disclosed herein. Instead, this disclosure is intended to also disclose the subject matter of any combination of any two or more of the claims, such that subsequent claim sets may recite that any one of the dependent claims depends from any other one or more claims, up to and including all other claims in the alternative (for example, "The apparatus or method of any one of the preceding or subsequent claims . . . "). This disclosure is also intended to disclose the subject matter of any one of the dependent claims, as if it was an independent claim, with or without all or a portion of the subject matter of the original independent claim(s) or any other subject matter disclosed herein.

The invention claimed is:

1. A lounge chair, comprising:

an inflatable backrest having:

an upper chamber including a first air valve; and a lower chamber including a second air valve, the upper chamber and lower chamber being selectively inflatable;

a mat coupled to the inflatable backrest;

a first connecting material to attach the upper chamber to the lower chamber, a second connecting material to attach the upper chamber to the mat; and a third connecting material to attach the lower chamber to the mat.

2. The lounge chair of claim 1, wherein air in the upper chamber is kept separate from air in the lower chamber.

3. The lounge chair of claim 1, wherein an upper surface of the upper chamber is configured to contact a back of a user.

4. The lounge chair of claim 3, wherein the upper surface includes a microfiber coating.

5. The lounge chair of claim 1, wherein a bottom surface of the lower chamber is configured to contact a ground surface.

6. The lounge chair of claim 1, wherein the inflatable backrest is foldable upon deflation of the upper chamber and lower chamber.

7. The lounge chair of claim 1, wherein, when the upper chamber is inflated, the upper chamber to retain an inflated shape upon deflation of the lower chamber.

8. The lounge chair of claim 1, wherein the upper chamber forms a wedge shape upon inflation of the upper chamber.

9. The lounge chair of claim 1, wherein the lower chamber forms a wedge shape upon inflation of the lower chamber.

10. The lounge chair of claim 1, wherein inflation of the upper and lower chambers provides approximately sixty degrees of adjustment to the inflatable backrest.

11. The lounge chair of claim 10, wherein inflation of the lower chamber provides approximately thirty degrees of adjustment to the inflatable backrest, and wherein inflation of the upper chamber provides approximately thirty degrees of adjustment to the inflatable backrest.

12. A method of using a lounge chair with an inflatable backrest, the method comprising:

providing the lounge chair, the lounge chair having:

the inflatable backrest having:

an upper chamber including a first air valve;

a lower chamber including a second air valve;

a mat coupled to the inflatable backrest;

a first connecting material to attach the upper chamber to the lower chamber, a second connecting material to attach the upper chamber to the mat; and a third connecting material to attach the lower chamber to the mat, inflating the upper chamber by inserting air into the first air valve; and inflating the lower chamber by inserting air into the second air valve.

13. The method of claim 12, wherein the air in the upper chamber is separate from the air in the lower chamber.

14. The method of claim 12, further comprising deflating the lower chamber by removing air through the second air valve.

15. The method of claim 14, wherein the upper chamber to retain an inflated shape independent of deflation of the lower chamber.

16. The method of claim 12, further comprising adjusting an angle of the inflated upper chamber relative to the mat by inflating or deflating the lower chamber.

17. The method of claim 12, further comprising deflating the upper chamber by removing air through the first air valve.

18. The method of claim 12, further comprising folding the lounge chair upon deflation of the upper chamber and the lower chamber.

* * * * *